US005206477A

United States Patent [19]

Stephenson

[11] Patent Number: 5,206,477

[45] Date of Patent: Apr. 27, 1993

[54] APPARATUS AND METHOD FOR REPLACING A FUSER BAR WITHOUT TOOLS

[75] Inventor: Stanley W. Stephenson, Spencerport, N.Y.

[73] Assignee: Eastman Kodak Company, Rochester, N.Y.

[21] Appl. No.: 894,676

[22] Filed: Jun. 5, 1992

[51] Int. Cl.[5] ..... G03G 15/20

[52] U.S. Cl. ..... 219/216; 219/388

[58] Field of Search ..... 219/216, 469, 470, 471, 219/388

[56] References Cited

U.S. PATENT DOCUMENTS

| | | | |
|---|---|---|---|
| 3,484,326 | 12/1969 | Grandinetti | 219/469 |
| 3,637,976 | 1/1972 | Ohta et al. | 219/216 |
| 4,121,089 | 10/1978 | Bishop | 219/216 |
| 4,163,893 | 8/1979 | Turini | 219/216 |
| 4,470,055 | 9/1984 | Todoh | 346/140 R |
| 4,541,708 | 9/1985 | Shigenobu . | |
| 4,791,448 | 12/1988 | Kawashima | 219/216 |
| 4,896,166 | 1/1990 | Barker et al. | 346/76 PH |
| 4,956,543 | 9/1990 | Shibata | 219/216 |
| 5,026,276 | 6/1991 | Hirabayashi | 219/216 |
| 5,051,784 | 9/1991 | Yamamoto | 219/216 |

*Primary Examiner*—Teresa J. Walberg
*Attorney, Agent, or Firm*—Raymond L. Owens

[57] ABSTRACT

An apparatus for fusing an image bearing receiver includes a frame having a pair of spaced apart slots. A pressure roller is pivotally mounted on the frame. A fuser bar has a heat absorbing surface and is slidable in the slots for insertion and removal. A radiant heat source is positioned below the slots and a reflector reflects radiant energy towards the heat absorbing surface of the fuser bar.

15 Claims, 2 Drawing Sheets

APPARATUS AND METHOD FOR REPLACING A FUSER BAR WITHOUT TOOLS

TECHNICAL FIELD OF THE INVENTION

The present invention relates generally to fusing an image on an image bearing surface, and, more particularly, to a method and apparatus for replacing a fuser bar.

BACKGROUND OF THE INVENTION

In typical thermal printers, a resistive element thermal head is used to transfer dye from a dye bearing donor web to a dye receiving member. The head, dye donor and receiver are brought into contact, and the thermal head elements are selectively energized to transfer variable quantities of thermal dye from the donor to the receiver. The receiver is advanced past the thermal head in a controlled manner so that sequential lines of pixels are generated until a complete image is formed on the dye receiver. The transferred dye remains close to the surface of the receiver and is susceptible to mechanical, chemical and thermal aging and deterioration. Increased printing speed is always desirable, but as a result, the dye image becomes even more susceptible to damage. In addition, mechanical deformation occurs in the print as speed increases and the quantity of dye increases.

Image stability can be improved by applying post printing heat to fuse the image. This can be done by passing the image between two heated rollers as is done in electrophotographic printers. In electrophotographic printers, the heat is provided by passing a lamp inside a rotating cylinder. Having the lamp inside allows full heat transfer to the roller while allowing the roller to rotate freely. However, a disadvantage of this system is that the mechanism must be completely disassembled when the heating element or roller has to be serviced.

In some printing processes, the dyes are reheated by rollers that apply a controlled amount of heat to the image bearing surface. Heater elements do not last forever and must be serviced and eventually replaced. Unfortunately, heater elements and fuser bars are not easily accessible. U.S. Pat. No. 4,896,166 discloses a replaceable thermal head that can be inserted and removed without tools. A difficulty with the replaceable thermal head is that it is an electrical device and requires electrical cabling to the printer. Accordingly, it will be appreciated that it would be highly desirable to have a fusing apparatus that provides even, constant temperature heat for fusing and that is easy to install and remove without tools.

SUMMARY OF INVENTION

The present invention is directed to overcoming one or more of the problems set forth above. Briefly summarized, according to one aspect of the invention, an apparatus for stabilizing dye on an image bearing surface includes a frame having a pair of spaced apart slots. A fuser bar has a heat absorbing surface and is slidable in the slots for insertion and removal. A radiant heat source is positioned below the slots and a reflector reflects radiant energy towards the heat absorbing surface of the fuser bar.

According to another aspect of the present invention, a method for inserting a fuser bar in a fusing apparatus without tools comprises aligning a pin on the fuser bar with a slot in a frame of the fusing apparatus, inserting the pin into the slot, and sliding the fuser bar until the pin abuts a bottom portion of the slot. Insertion also includes activating a lever arm and moving a temperature sensor into abutting contact with the fuser bar, and pivoting a pressure roller into fusing contact with the fuser bar and heating the fuser bar to stabilize a dye image on a medium positioned between the fuser bar and pressure roller.

A method for removing a fuser bar from a fusing apparatus without tools comprises pivoting a pressure roller and releasing any medium position between the fuser bar and pressure roller, removing said any medium from between the fuser bar and pressure roller and sliding the fuser bar until a pin on the fuser bar riding in a slot in a frame of the apparatus exits the slot. Removal also includes activating a lever arm and moving a temperature sensor into abutting contact with the fuser bar.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
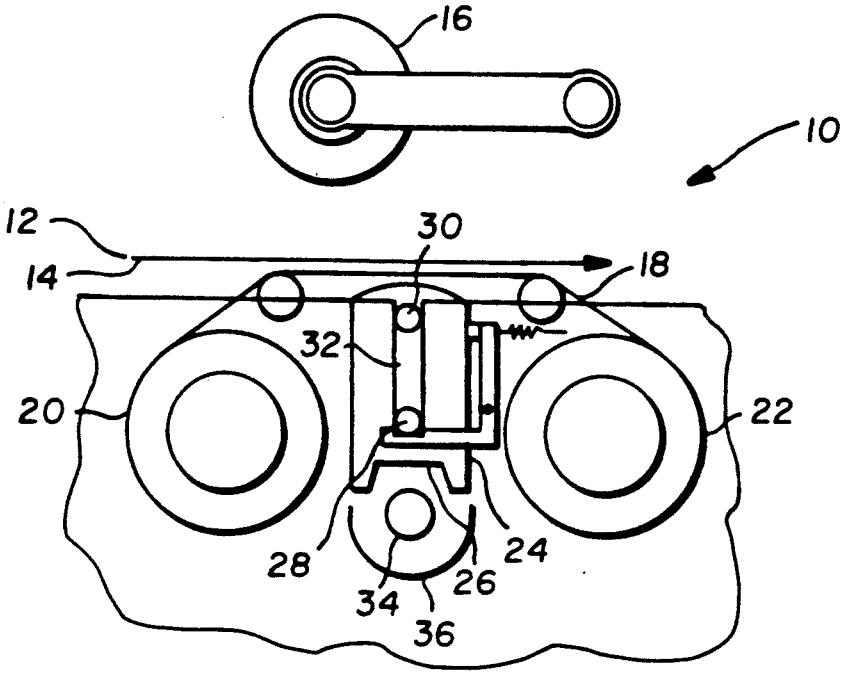
FIG. 1 is a diagrammatic view of a preferred embodiment of a thermal printer with a replaceable fuser bar.
Figure 2:
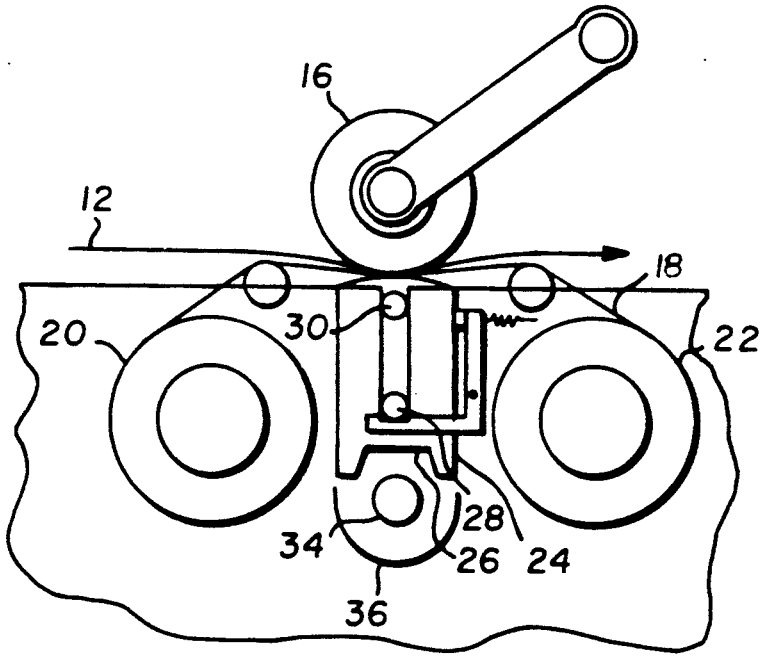
FIG. 2 is diagrammatic view illustrating the fuser bar during a fusing operation.
Figure 3:
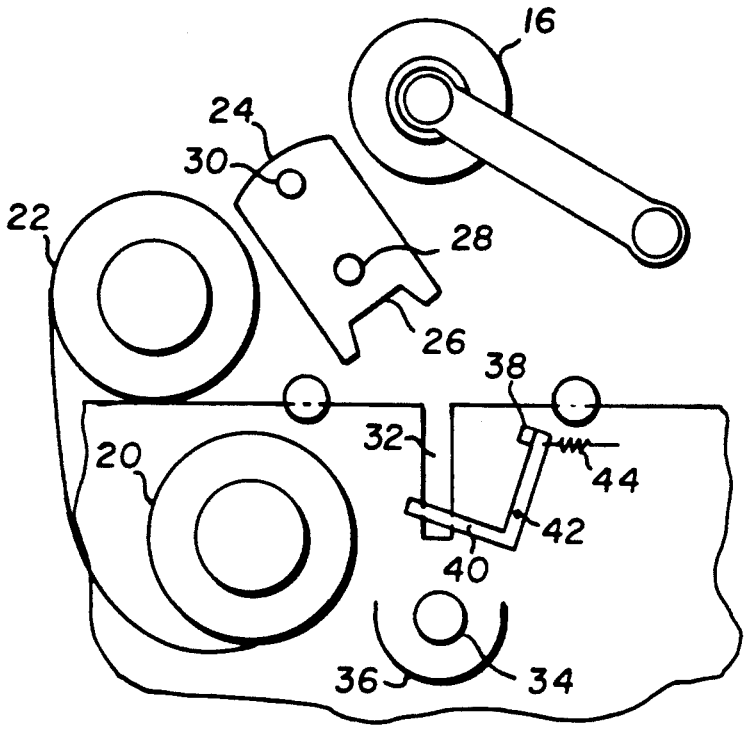
FIG. 3 is diagrammatic view illustrating the fuser bar being replaced.

Referring to FIGS. 1-3, an apparatus, such as a thermal printer 10 for example, is shown for treating a thermal dye receiver 12 having an image on a front surface 14 thereof. For the fusing operation, the receiver 12 is urged through the apparatus by a pressure roller 16. The roller 16 is preferably coated with a heat resistant elastomeric material, such as silicone rubber. A web 18 of protective material is supported on a supply roller 20 on one end and a take-up roller 22 on the other end. The protective web 18 traverses a path through the apparatus that brings it near the pressure roller 16 so that it faces the image side 14 of the receiver 12 in the vicinity of the pressure roller 16.

A fuser bar 24 is positioned opposite the receiver 12 and web 18 with the web 18 between the receiver 12 and fuser bar 24. The bar 24 preferably has a rectangular configuration to store and integrate heat energy. To effect good heat transfer, the energy receiving portion 26 has a rough surface, preferably formed by sandblasting, and a black organic dye applied as an anodizing operation. Two pins 28, 30 are located on each side of the bar 24 that are alignable with slots 32 in the frame of the thermal printer. The bar 24 drops into the slots 32 until the bottom pins 28 rest against the bottom of the slots 32. Alternatively, the bar 24 could be formed with projections instead of pins.

The fuser bar 24 is heated by a radiant heater that includes a heat lamp 34 and a reflector 36. The reflector 36 directs light toward the rough surface of the energy receiving portion 26 of the fuser bar 24. The heater is separate from the fuser bar 24 so that the bar 24 can be removed without disturbing the heater.

A temperature sensing element 38 is attached to a lever arm 40 that pivots about a pivot point such as pin 42. The lever arm 40 may be an angled member with one end containing the sensor 38 and with the other end selectively engaging the lower pins 28 of the fuser bar 24 to move the sensor to a closed position. The sensor 38 is biased, by a spring 44 or the like, toward an open position. The open position occurs when the pressure roller 16 is pivoted out of the insertion and removal path of the fuser bar 24, as shown in FIG. 3, and the fuser bar is removed. In the open position, the sensor 38 is biased away from contact with the fuser bar 24. At the closed position of FIG. 1, the sensor 38 abuts the fuser bar 24 to monitor its temperature. The sensor 38 is preferably positioned to detect the temperature of the heat transfer surface of the fuser bar 24.

Operation of the present invention is believed to be apparent from the foregoing description, but a few words will be added for emphasis. The movable pressure roller can be moved to press the receiver first against the web and then press both the receiver and web against the fuser bar (FIG. 2). As illustrated, gravity is sufficient to hold the fuser bar in place against the frame. A manually releasable fastener of ordinary construction can be used to retain the fuser bar in position to protect against displacement. The fuser bar is removed by first removing the web off of the fuser bar (FIG. 3). Next, the pressure roller is moved aside to allow for a release motion of the fuser bar. Any retaining components are released, and the bar is lifted out of the slot. The temperature sensor is automatically moved in response to insertion or removal of the fuser bar by the action of the lower pins on the lever arm.

It can now be appreciated that there has been presented an apparatus for replacing a fuser bar without tools. The apparatus comprises a frame having a pair of spaced apart slots, and a fuser bar having pins for slidably engaging the slots for insertion and removal of the fuser bar without tools. A pressure roller is pivotally mounted on the frame for pressing the image bearing surface into image fusing contact with the fuser bar, and for pivoting out of the way for toolless removal of the fuser bar.

It can also be appreciated that there has been presented a method for removing and inserting a fuser bar without tools. The method for inserting a fuser bar in a fusing apparatus without tools comprises aligning a pin on the fuser bar with a slot in a frame of the fusing apparatus, inserting the pin into the slot, and sliding the fuser bar until the pin abuts a bottom portion of the slot. Insertion also includes activating a lever arm and moving a temperature sensor into abutting contact with the fuser bar, and pivoting a pressure roller into fusing contact with the fuser bar and heating the fuser bar to stabilize a dye image on a medium positioned between the fuser bar and pressure roller.

The method for removing a fuser bar from a fusing apparatus without tools comprises pivoting a pressure roller and releasing any medium position between the fuser bar and pressure roller, removing said any medium from between the fuser bar and pressure roller and sliding the fuser bar until a pin on the fuser bar riding in a slot in a frame of the apparatus exits the slot. Removal also includes activating a lever arm and moving a temperature sensor into abutting contact with the fuser bar.

While the invention has been described with particular reference to the preferred embodiments, it will be understood by those skilled in the art that various changes may be made and equivalents may be substituted for elements of the preferred embodiment without departing from invention. For example, the protective web may omitted depending upon the thermal process involved, the dye characteristics and the temperatures involved. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. An apparatus for stabilizing dye on an image bearing surface, comprising:

a frame having a pair of spaced apart slots;

a fuser bar having a temperature, a heat radiating surface, a heat absorbing surface, and means for slidably engaging said slots for insertion and removal of said fuser bar;

a temperature sensor for sensing the temperature of said fuser bar; and means for moving said temperature sensor into temperature sensing contact with said fuser bar in response to insertion of said fuser bar and for moving said temperature sensor away from temperature sensing contact with said fuser bar in response to removal of said fuser bar.

2. An apparatus, as set forth in claim 1, including means for heating said fuser bar.

3. An apparatus, as set forth in claim 2, wherein said means for heating includes a radiant heat source.

4. An apparatus, as set forth in claim 3, wherein said radiant heat source is positioned below said slots.

5. An apparatus, as set forth in claim 2, wherein said means for heating includes a reflector positioned to reflect radiant energy towards said heat absorbing surface.

6. An apparatus, as set forth in claim 1, including a pressure roller pivotally mounted on said frame for pressing said image bearing surface into image fusing contact with said fuser bar.

7. An apparatus, as set forth in claim 1, wherein said image bearing surface is a front surface of a thermal dye receiver.

8. An apparatus, as set forth in claim 1, including means for biasing said temperature sensor away from said fuser bar.

9. An apparatus, as set forth in claim 1, including means for biasing said temperature sensor away from said fuser bar.

10. A method for inserting a fuser bar in a fusing apparatus without tools, comprising the steps of:

aligning a pin on the fuser bar with a slot in a frame of the fusing apparatus;

inserting the pin into the slot;

sliding the fuser bar until the pin abuts a bottom portion of the slot; and activating a lever arm and moving a temperature sensor into abutting contact with the fuser bar.

11. A method, as set forth in claim 10, including the step of pivoting a pressure roller into fusing contact with the fuser bar and heating the fuser bar to stabilize a dye image on a medium positioned between the fuser bar and pressure roller.

12. A method for removing a fuser bar from a fusing apparatus without tools, comprising the steps of:

pivoting a pressure roller and releasing any medium positioned between the fuser bar and pressure roller;

removing said any medium from between the fuser bar and pressure roller;

sliding the fuser bar until a pin on the fuser bar riding in a slot in a frame of the apparatus exits the slot; and activating a lever arm and moving a temperature sensor out of abutting contact with the fuser bar.

13. An apparatus for stabilizing dye on an image bearing surface, comprising:

a frame having a pair of spaced apart slots;

a radiant heat source positioned below said slots for generating heat for stabilizing dye on said image bearing surface;

a fuser bar having a heat absorbing surface for absorbing heat generated by said radiant heat source and a heat radiating surface for radiating absorbed heat to said image bearing surface;

a reflector positioned to reflect radiant energy towards said heat absorbing surface; and means on said fuser bar for slidably engaging said slots for insertion and removal of said fuser bar without disturbing said reflector.

14. An apparatus, as set forth in claim 13, including a temperature sensor movable into abutting contact with said fuser bar in response to insertion of said fuser bar.

15. An apparatus, as set forth in claim 13, including a temperature sensor movable away from said fuser bar in response to removal of said fuser bar.

* * * * *